US007560019B2

(12) United States Patent
McCoy et al.

(10) Patent No.: US 7,560,019 B2
(45) **Date of Patent: *Jul. 14, 2009**

(54) SYSTEM AND METHOD FOR EXTENDING THE RANGE OF HYDROCARBON FEEDS IN GAS CRACKERS

(75) Inventors: James N. McCoy, Houston, TX (US); Walter F. Filupeit, Houston, TX (US); Barrington M. Hammond, Houston, TX (US); David J. Duhon, Kingwood, TX (US); Mark A. Rooney, Humble, TX (US); Robert A. Strack, Houston, TX (US); John R. Messinger, Kingwood, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 235 days.

This patent is subject to a terminal disclaimer.

(21) Appl. No.: 11/633,823

(22) Filed: Dec. 5, 2006

(65) Prior Publication Data

US 2008/0128326 A1 Jun. 5, 2008

(51) Int. Cl.
*C10G 55/04* (2006.01)
*B01J 8/04* (2006.01)

(52) U.S. Cl. ..... 208/69; 208/106; 208/125; 208/130; 422/189

(58) Field of Classification Search ..... 208/69, 208/106, 125, 130; 422/189
See application file for complete search history.

(56) References Cited

U.S. PATENT DOCUMENTS 2,901,418 A 8/1959 Pappas
7,097,758 B2 8/2006 Stell et al.
2004/0004022 A1 1/2004 Stell et al.

(Continued)

FOREIGN PATENT DOCUMENTS

GB 1 390 382 4/1975

(Continued)

OTHER PUBLICATIONS

U.S. Appl. No. 11/487,780, Stell, et al., entitled "Process for Steam Cracking Heavy Oil Hydrocarbon Feed Stock", filed Jul. 17, 2006.

(Continued)

*Primary Examiner*—Glenn Caldarola
*Assistant Examiner*—Prem C. Singh

(57) ABSTRACT

In a system for thermal cracking gaseous feedstocks, the system including a gas cracker for producing an effluent comprising olefins, at least one transfer line exchanger for the recovery of process energy from the effluent and a water quench tower system, a process for extending the range of system feedstocks to include liquid feedstocks that yield tar is provided. The process includes the steps of injecting a first quench fluid downstream of the at least one transfer line exchanger to quench the process effluent comprising olefins, separating in a separation vessel a cracked product and a first byproduct stream comprising tar from the quenched effluent, directing the separated cracked product to the water quench tower system and quenching the separated cracked product with a second quench fluid to produce a cracked gas effluent for recovery and a second byproduct stream comprising tar. An apparatus for cracking a liquid hydrocarbon feedstock that yield tar is also provided.

31 Claims, 1 Drawing Sheet

U.S. PATENT DOCUMENTS

| | | | | |
|---|---|---|---|---|
| 2004/0004027 | A1 * | 1/2004 | Spicer et al. | 208/130 |
| 2005/0209495 | A1 | 9/2005 | McCoy et al. | |
| 2005/0261537 | A1 | 11/2005 | Stell et al. | |

FOREIGN PATENT DOCUMENTS

| | | |
|---|---|---|
| WO | 93/12200 | 6/1993 |
| WO | WO 01/66672 A1 * | 9/2001 |

OTHER PUBLICATIONS

U.S. Appl. No. 11/177,975, Strack et al., entitled "Method for Processing Hydrocarbon Pyrolysis Effluent" filed Jul. 8, 2005.
U.S. Appl. No. 10/188,461, Stell et al., "Process for Steam Cracking Heavy Oil Hydrocarbon Feed Stock" filed Jul. 3, 2002.
U.S. Appl. No. 11/178,025, Strack et al., entitled "Method for Processing Hydrocarbon Pyrolysis Effluent" filed Jul. 8, 2005.

* cited by examiner

SYSTEM AND METHOD FOR EXTENDING THE RANGE OF HYDROCARBON FEEDS IN GAS CRACKERS

FIELD OF THE INVENTION

The present invention relates to the cracking of hydrocarbons that contain relatively non-volatile hydrocarbons and other contaminants. More particularly, the present invention relates to extending the range of feedstocks available to a steam cracker.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products comprising olefins leave the pyrolysis furnace for further downstream processing, including quenching.

Pyrolysis involves heating the feedstock sufficiently to cause thermal decomposition of the larger molecules. The pyrolysis process, however, produces some molecules that tend to combine to form high molecular weight materials known as tar. Tar is a high-boiling point, viscous, reactive material that can foul equipment under certain conditions. In general, feedstocks containing higher boiling materials tend to produce greater quantities of tar.

Olefin gas cracker systems are normally designed to crack ethane, propane and on occasion butane, but typically lack the flexibility to crack heavier feedstocks, such as liquids, particularly those feedstocks that produce tar in amounts greater than one percent. As gas feeds tend to produce little tar, primary, secondary, and even tertiary transfer line exchangers (TLEs) are utilized to recover energy through the generation of high pressure and medium pressure steam, as the furnace effluent cools from the furnace outlet to the quench tower inlet. TLE fouling on the process side is very limited with gas feeds, since the tar yields are very low.

The process gas is normally then fed to a quench tower wherein the process gas is further cooled by direct contact with quench water. Typically, the bottoms of the quench tower feed a quench drum, which functions as a three-phase separator, with a light hydrocarbon phase that floats on water and tar, which sinks in water, as the bottom phase. Even in the case of cracking ethane feed, the tar yield is high enough to cause the water leaving the quench drum to contain enough light tar, which has a specific gravity close to that of water, to cause downstream fouling of the quench circuit. This can result in the fouling of downstream heat exchangers and water stripping towers, which, when fouled, must be taken offline for cleaning.

Conventional steam cracking systems have been effective for cracking high-quality feedstocks which contain a large fraction of light volatile hydrocarbons, such as gas oil and naphtha. However, steam cracking economics sometimes favor cracking lower cost feedstocks containing resids such as, by way of non-limiting examples, atmospheric residue, e.g., atmospheric pipe still bottoms, and crude oil. Crude oil and atmospheric residue often contain high molecular weight, non-volatile components with boiling points in excess of 590° C. (1100° F.). The non-volatile components of these feedstocks lay down as coke in the convection section of conventional pyrolysis furnaces. Only very low levels of non-volatile components can be tolerated in the convection section downstream of the point where the lighter components have fully vaporized.

Additionally, during transport, some naphthas or other lighter liquids are contaminated with heavy crude oil containing non-volatile components. Conventional pyrolysis furnaces do not have the flexibility to process residues, crudes, or many residue or crude contaminated gas oils or naphthas which comprise non-volatile components.

As indicated, in most commercial naphtha crackers, cooling of the effluent from the cracking furnace is normally achieved using a system of transfer line heat exchangers, a primary fractionator and a water quench tower or indirect condenser. The steam generated in transfer line exchangers can be used to drive large steam turbines which power the major compressors used elsewhere in the ethylene production unit. To obtain high energy-efficiency and power production in the steam turbines, it is necessary to superheat the steam produced in the transfer line exchangers.

Cracking heavier feeds, such as kerosenes and gas oils, may produce large amounts of tar, which can lead to rapid coking in the radiant section of the furnace as well as fouling in the transfer line exchangers preferred in lighter liquid cracking service, often requiring costly shutdowns for cleaning. Furthermore, if a quench liquid such as water is used, the heavy oils and tars may form stable emulsions that make it difficult to dispose of excess quench water in an environmentally acceptable manner.

As indicated above, one technique used to further quench the effluent produced by steam cracking and remove the resulting heavy oils and tars employs a water quench tower in which the condensables are removed at near ambient conditions. Such a water quench technique has proven acceptable when cracking light gases, primarily ethane, although the quench water still may have significant amounts of hydrocarbons present, which serve to foul the water quench circuit. An alternative and more complex technique utilizes an oil quench with fractionation to remove the heavier tars, followed by a water quench to remove other condensables and complete the cooling. This technique is most practical for naphtha or heavy oil crackers which produce from about 1.0 wt % tar to greater than about 30 wt % tar.

Neither of these techniques is, however, entirely optimum for use in steam crackers that crack liquefied petroleum gases, light naphthas, and ethane that produce relatively little heavy oil and tar. One issue with these feedstocks stems from the fact that some of the heavy oils and tars produced when the pyrolysis effluent of these feedstocks is quenched have approximately the same density as water and can form stable oil/water emulsions. Emulsion formation can render water quench operations ineffective, causing dilution steam generators to foul, and make disposal of excess quench water in an environmentally acceptable manner difficult. Moreover, this further complicates the disposal of heavy oil and tar.

Alternatively, a primary fractionator would prevent the formation of oil/water emulsions by removing the heavy oils and tars in the primary oil quench stage. Such a system could, however, be more costly to construct and operate than a simple water quench system. Additionally, the primary fractionator system may not generate sufficient heavy oil to allow it to replenish its own quench oil, some of which must be continuously removed to dispose of accumulated tars. As such, operation of a primary fractionator under these conditions would require the added expense of an external supply of quench oil. Furthermore, logistical difficulties are presented if the cracker is not located adjacent to a facility capable of providing quench oil and removing spent oil.

Steam crackers designed to operate on gaseous feedstocks, while limited in feedstock flexibility, require significantly lower investment when compared to liquid feed crackers designed for naphtha and/or heavy feedstocks that produce higher amounts of tar and byproducts. However, as may be appreciated, when the price of natural gas is high relative to crude, gas cracking tends to be disadvantaged when compared with the cracking of virgin crudes and/or condensates, or the distilled liquid products from those feeds. (e.g., naphtha, kerosene, field natural gasoline, etc). In such an economic environment, it would be desirable to extend the range of useful feedstocks to include liquid feedstocks that yield higher levels of tar. Therefore, there is a need for an improved method of quenching effluent and removing the resulting heavy oils and tars.

SUMMARY OF THE INVENTION

In a preferred aspect, this invention provides processes and apparatus to enable production of olefin products using a gas cracker fed with liquid hydrocarbon feedstocks. In one aspect, provided is a process for extending the range of gas cracker system feedstocks to include liquid feedstocks such as light virgin naphtha (LVN), heavy virgin naphtha (HVN), field natural gasoline (FNG), condensate, crude, and kerosene, including such products that may yield tar, such as at least 2 wt % tar, or even such as up to 10 wt % tar, and even up to 15 wt % tar, after cracking. The inventive process may be used in a system that traditionally may be used for cracking gaseous feedstocks, such as ethane, that includes a steam or gas cracker that produces an effluent comprising olefins.

In a preferred embodiment, the inventive system includes a gas cracker, at least one transfer line exchanger for the recovery of process energy from the effluent, and a quench tower system. To control buildup of tar produced by the cracker, the inventive system includes in a preferred aspect, a tar knockout system between the transfer line heat exchanger and the water quench tower system, a tar salvation system to cleanse and remove tar from the quench tower quench fluid. More preferably, the system also includes a flash separator to remove at least a portion of the nonvolatile components from the convection section of the cracker, before the remaining feed components are cracked in the radiant section of the cracker.

The inventive process also includes the steps of injecting a first quench fluid downstream of the at least one transfer line exchanger to quench the process effluent comprising olefins, separating in a separation vessel a cracked product and a first byproduct stream comprising tar from the quenched effluent, directing the separated cracked product to the water quench tower system and quenching the separated cracked product with a second quench fluid to produce a cracked gas effluent for recovery and a second byproduct stream comprising tar.

In another aspect, the process further includes the steps of injecting a light aromatic solvent into the second byproduct stream comprising tar to form a solvent/second byproduct mixture; directing the solvent/second byproduct mixture to a tar solvation quench drum; and separating in the tar solvation quench drum a recycled water stream and a third byproduct stream comprising tar.

In a preferred aspect, the invention includes a process, apparatus, and system for cracking hydrocarbon liquids in a gas cracker system, such as an ethane cracker. In another aspect, this invention provides processes and apparatus for managing tar cracker products from the cracked effluent stream and to control deposition and buildup of the same. The invention still further provides methods and processes for producing a clean quench water effluent after final separation of the tar byproduct from the quench tower fluids and produced products streams.

In yet another aspect, the process may be used in a system for thermal cracking feeds that contain high levels of asphaltenes, such as crude oil gaseous feedstocks, the system further including a flash/separation apparatus, external, but integrated in the convection section of a steam cracker for cracking a vapor phase overhead produced by the flash/separation apparatus. The flash/separator drum bottoms may be sent to fuel or potentially to a fluid catalytic cracker, or a coker unit.

Alternatively, in yet another aspect, the process further includes the steps of directing the second byproduct mixture to a tar solvation quench drum, separating in the tar solvation quench drum a recycled water stream and a third byproduct stream comprising tar, injecting a light aromatic solvent into the third byproduct comprising tar to form a solvent/third byproduct mixture, and directing the solvent/third byproduct mixture to a solvent separation drum to produce a process condensate and a light aromatic solvent/dissolved tar stream Alternatively, in still yet another aspect, the process further includes the steps of directing the solvent/second byproduct mixture to a tar solvation quench drum, separating in the tar solvation quench drum a recycled water stream and a third byproduct stream comprising tar, injecting a light aromatic solvent into the recycled water stream to form a solvent/water mixture and directing the solvent/water mixture to the water quench tower system.

In a further aspect, provided is an apparatus for cracking a liquid hydrocarbon feedstock in a gas cracker system, such as a feedstock that yields after cracking at least about 2 wt % tar, preferably even feedstocks that yield up to 10 wt % tar, and in some more preferred aspects, feeds that may yield up to 15 wt % tar. The apparatus may include, in one aspect, (i) a gas or steam cracker for cracking a liquid hydrocarbon feedstock comprising a convection section and a radiant section for cracking the vapor phase of the vapor overhead to produce a process effluent comprising olefins; (ii) at least one transfer line exchanger for the recovery of process energy from the process effluent; (iii) preferably a water or quench oil injection line positioned downstream of the at least one transfer line exchanger for quenching the process effluent; (iv) a first separation vessel, preferably a tar knockout vessel, for separating a cracked product and a first byproduct stream comprising tar from the quenched effluent, the first separation vessel positioned downstream of the water or quench oil injection line; (v) a second separator, preferably a quench tower system and more preferably a water quench tower system, for quenching the separated cracked product to produce a cracked gas effluent for recovery and a second byproduct stream comprising tar; (vi) a tar solvation system, preferably such system that includes a quench drum for receiving the second byproduct stream, the tar solvation quench drum positioned downstream of the quench tower system for receiving the second byproduct stream comprising tar; and (vii) preferably, a recovery train for recovering cracked product from the cracked gas effluent.

In yet a further aspect, at least one transfer line exchanger for the recovery of process energy from the effluent includes a first transfer line exchanger and a second transfer line exchanger, the second transfer line exchanger positioned downstream of the first transfer line exchanger and in fluid communication therewith, wherein steam or quench oil is injected upstream of the first transfer line exchanger for cleaning the first transfer line exchanger.

In still another aspect, a solvent is injected upstream of the second transfer line exchanger for cleaning the second transfer line exchanger.

In still another aspect a vapor/liquid separation zone for treating vapor/liquid mixtures of hydrocarbons to provide a vapor overhead and liquid bottoms is provided.

These and other features will be apparent from the detailed description taken with reference to accompanying drawings.

BRIEF DESCRIPTION OF THE DRAWING

The FIG. 1 is a schematic diagram of an exemplary system for carrying out a process of the type disclosed herein.

DETAILED DESCRIPTION OF PREFERRED EMBODIMENTS

Figure 1:
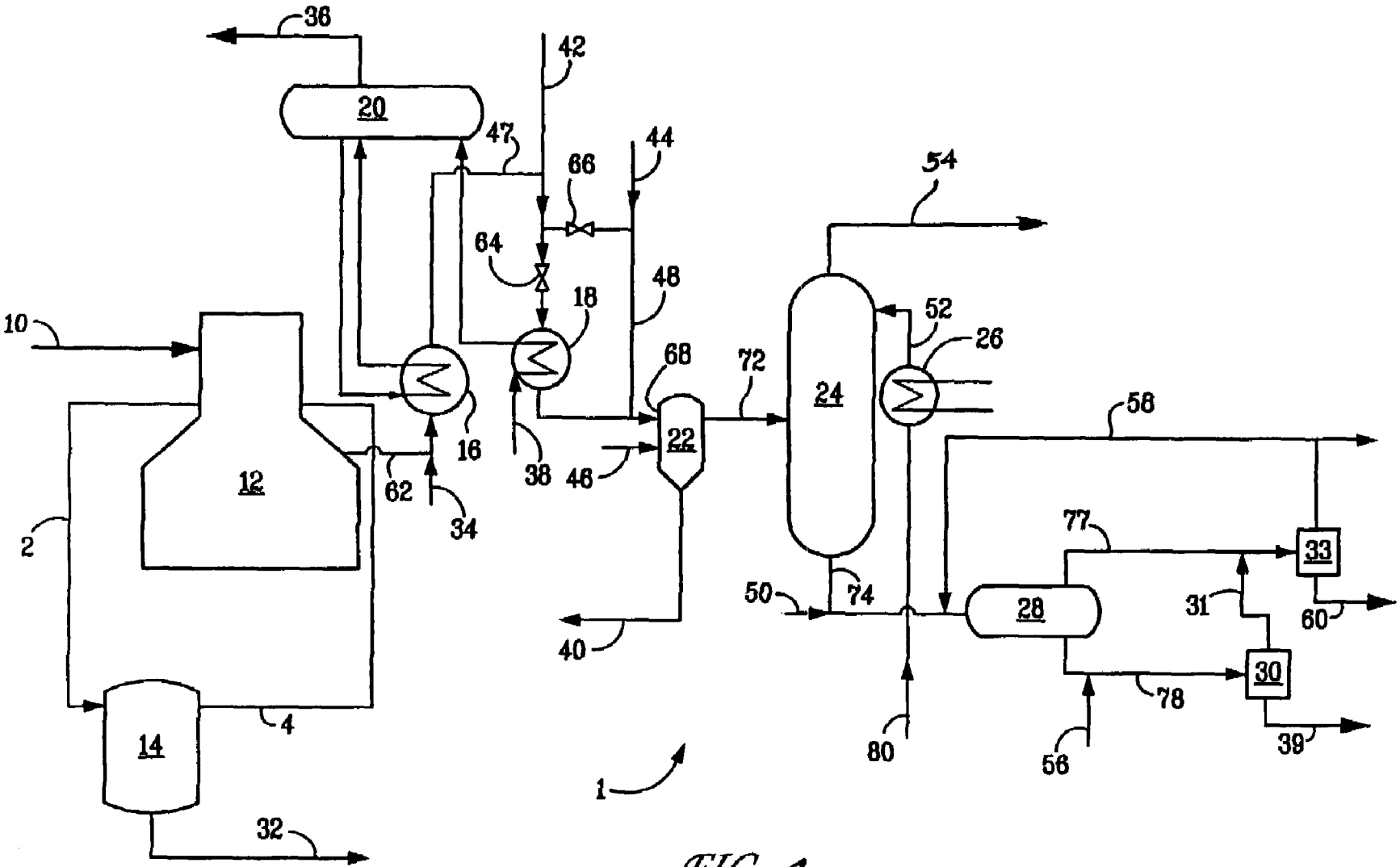

Various aspects will now be described with reference to specific embodiments selected for purposes of illustration. It will be appreciated that the spirit and scope of the process and system disclosed herein is not limited to the selected embodiments. Moreover, it is to be noted that the FIGURE provided herein is not drawn to any particular proportion or scale, and that many variations can be made to the illustrated embodiments. Reference is now made to the FIGURE, wherein like numerals are used to designate like parts throughout.

Disclosed herein is a process for extending the range of gas cracker system feedstocks to include liquid feedstocks, including feeds that yield tar, even for example up to 15 wt % tar, after cracking. The process may extend gas cracker flexibility to crack virgin crudes, condensates and/or the distilled liquid products from those feeds, such as naphtha, kerosene, field natural gasoline, etc.

Liquid feedstocks that may be employed herein may be any feedstock adapted for cracking insofar as they may be cracked into various olefins, and may contain heavy fractions such as high-boiling fractions and evaporation residuum fractions. Such liquid feedstocks may also include condensates and FNG, if transported on a crude ship. FNG is associated oil occurring in a small quantity in the production of natural gas from natural gas fields. The evaporation residuum fractions from crude contamination are fractions which remain as evaporation residuum convection section in preheaters provided in a cracking furnace for cracking the feedstock. The high-boiling fractions are fractions which do evaporate in the preheater, but which are likely to produce high-boiling substances (i.e., tar) which condense in a quenching heat exchanger after the cracking.

The liquid feedstocks that may be employed herein include, not only those heavy fraction-containing feedstocks adapted for cracking, such as condensate and FNG as mentioned above, but also those having an appropriate proportion of high-quality feedstocks such as naphtha blended thereto.

Furnaces designed for gas feeds can run liquid feedstocks, such as LVN, HVN, FNG, condensates, and kerosene, with modifications to the convection section and radiant inlet flow distribution, unless the feed contains non-volatile heavy components in crude or the residue from crude. For crude, and other liquid feeds contaminated by crude, such as condensates transported on ships that also transport crude, such feeds can be cracked when an external flash/separation apparatus 14, which serves to remove the non-volatile components, is employed. Flash/separation apparatus 14 removes the non-volatile components in the bottoms, and the overhead free of non-volatiles is fed back to the convection section of gas cracker 12 and further processed.

The FIGURE presents a schematic representation illustrating a steam cracking system of a type disclosed herein. As illustrated in FIG. 1, a steam cracking system 1 includes a steam cracking furnace 12, which includes a convection section in the upper part of the steam cracking furnace 12 and a radiant section in the lower part of the steam cracking furnace 12. In the convection section of the thermal cracking furnace, there may be disposed, as is conventional, a tube-type first preheater, an economizer tube, a tube-type second preheater, and a tube-type dilution-steam superheater (not shown), from the top to the bottom. In the radiant section of the cracking furnace 12 are disposed, as is typical, a thermal cracking reactor comprising a tubular reactor, and a burner (not shown) for heating the cracking furnace.

A feed line 10 supplies a liquid hydrocarbon feedstock to gas cracker furnace 12. Within cracking furnace 12, the hydrocarbon feed is heated to cause thermal decomposition of the molecules. Steam may also be introduced into the feed stream to assist the effluent/feed cracking and conversion. As may be appreciated by those skilled in the art, the steam cracking process occurring in cracking furnace 12 may undesirably produce some molecules which tend to react to form heavy oils and tars.

In some preferred processes or embodiments, some liquid feeds such as crudes or other heavier liquid feeds, may yield a relatively high tar content after cracking, such as greater than about 2 wt %. In such processes, it may be preferred that a flash stream 2 is removed from the convection section of cracking furnace 12 and is sent to flash/separation vessel 14. Optionally, a portion of feedstock 10 may be blended into flash stream 2 before entering flash/separation vessel 14. Flash stream 2 is then flashed in a flash/separation vessel 14, for separation into two phases: a vapor phase comprising predominantly volatile hydrocarbons flashed from the hydrocarbon feedstock 10 and a liquid phase comprising less-volatile hydrocarbons along with a significant fraction of the non-volatile components and/or coke precursors. It is understood that vapor-liquid equilibrium at the operating conditions described herein would result in small quantities of non-volatile components and/or coke precursors present in the vapor phase. Additionally, and varying with the design of the flash/separation vessel, quantities of liquid containing non-volatile components and/or coke precursors could be entrained in the vapor phase.

For ease of description herein, the term flash/separation vessel will be used to mean any vessel or vessels used to separate the flash stream 2 and/or optional feedstock 10 into a vapor phase and at least one liquid phase. Preferably, a pressure drop may also be provided to encourage vaporization of as much feedstock as possible. It is intended to include fractionation and any other method of separation, for example, but not limited to, drums, distillation towers, and centrifugal separators. Flash separators having utility herein are disclosed in U.S. Publication No. 2005/0261537, filed on May 21, 2004, and U.S. patent application Ser. No. 10/188,461, filed Jul. 3, 2002, the contents of which are hereby incorporated by reference in their entirety.

The flash stream 2, and optional feedstock 10 mixture stream, is introduced to the flash/separation vessel 14 through at least one inlet and the vapor phase is preferably removed from the flash/separation vessel 14 as an overhead vapor stream 4. The vapor phase is fed back to the convection section of cracking furnace 12, which preferably may be located nearest the radiant section of cracking furnace 12, for heating, and then to the radiant section of the cracking furnace 12 for cracking. The liquid phase of the flashed mixture stream is removed from the flash/separation vessel 14 as a bottoms stream 32.

While, in operation, it is useful to maintain a predetermined constant ratio of vapor to liquid in the flash/separation vessel 14, such a ratio is difficult to measure and control. As an alternative, the temperature of the flash stream 2 and optional feedstock 10 mixture stream before the flash/separation vessel 14 can be used as an indirect parameter to measure, control, and maintain an approximately constant vapor to liquid ratio in the flash/separation vessel 14. Ideally, when the mixture stream temperature is higher, more volatile hydrocarbons will be vaporized and become available, as part of the vapor phase, for cracking. However, when the mixture stream temperature is too high, more heavy hydrocarbons, including coke precursors, will be present in the vapor phase and carried over to the convection furnace tubes, eventually coking the tubes due to thermal cracking in the separation vessel. If the flash stream 2 and optional feedstock 10 mixture stream temperature is too low, resulting in a low ratio of vapor to liquid in the flash/separation vessel 14 a higher percentage of volatile hydrocarbons will remain in liquid phase and thus will not be available for cracking.

The flash stream 2, and optional feedstock 10 mixture stream, temperature may be controlled to maximize recovery or vaporization of volatiles in the feedstock while avoiding excessive coking in the furnace tubes or coking in piping and vessels conveying the mixture from the flash/separation vessel 14 to the cracking furnace 12 via line 4. The pressure drop across the piping and vessels conveying the mixture to the lower convection section and the crossover piping of the cracking furnace 12, and the temperature rise across the lower convection section of the cracking furnace 12 may be monitored to detect the onset of coking problems. For instance, if the crossover pressure and process inlet pressure to the lower convection section of cracking furnace 12 begin to increase rapidly due to coking, the temperature in the flash/separation vessel 14 and the flash stream 2 and optional feedstock 10 mixture stream should be reduced. If coking occurs in the lower convection section, the temperature of the flue gas to the upper furnace sections should be increased.

The selection of the flash stream 2 and optional feedstock 10 mixture stream temperature may also be determined by the composition of the feedstock materials. When the feedstock contains higher amounts of lighter hydrocarbons, the temperature of the flash stream 2 and optional feedstock 10 mixture stream can be set lower. When the feedstock contains a higher amount of less- or non-volatile hydrocarbons, the temperature of the flash stream 2 and optional feedstock 10 mixture stream should be set higher.

Typically, the temperature of the flash stream 2 and optional feedstock 10 mixture stream can be set and controlled at between about 315 and about 540° C. (about 600 and about 1000° F.), such as between about 370 and about 510° C. (about 700 and about 950° F.), for example between about 400 and about 480° C. (about 750 and about 900° F.), and often between about 430 and about 475° C. (about 810 and about 890° F.). These values will change with the volatility of the feedstock as discussed above.

The gaseous product effluent from the steam cracking furnace 12 is transferred through line 62 for cooling within at least one transfer line exchanger 16 (primary TLE). Steam is supplied by steam drum 20 for heat exchange with the product effluent within primary TLE 16. In conventional systems, when the feedstock window is broadened to include feeds that make greater than 2 wt % tar, the primary TLE 16, which generates high pressure steam, may foul with condensed heavy components from the tar, increasing outlet temperature substantially, while reducing high steam generation.

The present invention provides processes and apparatus, to address system fouling issues for increased steam cracker tar yield rates, such as yield rates of up to 10 wt % or even up to 15 wt %, or for example from 2 wt %, or from 2 wt % to 10 wt %. In addition to the other inventive aspects according to this invention, in one preferred aspect the primary TLE 16 may be modified to provide the capability of adding periodic steam or quench oil flushing to the hydrocarbon effluent feeding primary TLE 16. Steam or quench oil may be injected intermittently into line 34 to remove condensed tar foulant preferably before it crosslinks and/or hardens. Steam or quench oil flushing may be performed routinely, such as once or more times per day, for periods of about 15 minutes to about 30 minutes per day or per session, per TLE tube or even up to 60 minutes per day or per session. More severe cases may even require flushing or quenching as frequently as once each hour, typically for a period of less than about 60 minutes per session. Advantageously, steam or quench oil cleaning is done on each TLE octant or quadrant to minimize the impact on downstream operations. This enables the primary TLE 16 to run continuously while maximizing steam generation with feeds that include up to 10 wt % tar, such as kerosene or crude. As may be appreciated by those skilled in the art, it may be necessary to upgrade the metal components downstream of primary TLE 16 to the quench section to allow higher primary TLE outlet temperatures.

To achieve additional heat exchange prior to the effluent reaching the quench section, a secondary TLE 18 may be employed downstream of the primary TLE 16. Steam may be supplied through line 38 and returned to steam drum 20 following heat exchange with the product effluent within secondary TLE 18. To maintain the operability of the secondary TLE 18 and keep it relatively free from fouling from condensed tar, a non-fouling aromatic solvent may be intermittently as needed, injected into line 42, that is heavy enough not to flash at secondary TLE conditions. Suitable solvents may include the 430° F. to 550° F. (221-288° C.) fraction of the steam cracking product effluent. As may be appreciated by those skilled in the art, the yield for such a solvent is high enough during crude and kerosene cracking, but would be expected to be insufficient, requiring importation, for the case where the liquid feed is naphtha, field natural gasoline, or condensates.

In another preferred aspect, the secondary TLE(s) 18 is bypassed, such as through the use of valves 64 and 66, with the process effluent quenched through the use of direct water or quench oil injection, which may be injected into the effluent, for example at line 44. This exemplary form finds particular utility with gas crackers, since the typical gas cracker does not make enough solvent for injection into the secondary TLE 18 when the feed is naphtha, condensate, or field natural gasoline. Additionally, the solvent for the secondary TLE 18 is typically a highly aromatic, high gravity stream that does separate from water as easily after passing through the quench system, as would a lighter aromatic solvent, such as pyrolysis gasoline. Bypassing the secondary TLE also offers the advantage of not having to remove tar buildup from the secondary TLE while processing liquid feeds in a gas cracker system. It is a key benefit that the bypass stream may be quenched by injection of a quench fluid, such as through line 44 into line 48 on FIG. 1, to quench the hot effluent in the transfer line 48, instead of cooling through a secondary TLE. The hot effluent in line 48 has to be cooled/quenched before the effluent enters tar knockout separator 22 so that the condensables and tar will condense for removal from the effluent. This quenching may be accomplished using either steam or a quench oil, such as for example an oil fraction having a boiling point of from 230° C.-290° C. (450° F.-550° F.). Injecting the quench oil after the first TLE 16, such as using feed line 44, also permits oil quenching without risking cracking of the quench oil, such as might occur if the quench oil were injected upstream of the primary TLE 16. Quench oil may be preferred over steam, as in addition to quenching the effluent, the quench oil may also provide some solvation activity to prevent tar deposition in line 48. Injecting steam in line 44 is also an alternative to quench the effluent, as the injected steam could serve to reduce the hydrocarbon partial pressure so that the tar foulant volatizes or vaporizes before it deposits on the wall of line 44 or before it cross links into a hardened tar.

The gaseous effluent in line 48 is quenched to maintain a specified target temperature at the inlet 68 to the separation vessel 22. The target temperature must be high enough to prevent the precipitation of heavy oils and tars in line 48. Either quench oil or water can be used. The liquid water injected through line 44 into line 48 is provided at a rate sufficient to maintain a target temperature just above the dew point of water at the pressure condition at the inlet to the separation vessel 22. For the typical effluent of mid-range hydrocarbons, such as liquefied petroleum gases and light naphthas, at typical operating pressures, the target temperature may be in the range of about 105° C. to about 130° C. (221-266° F.).

The gaseous effluent stream next enters separation vessel 22, which may be for example, in the form of a separation drum or a cyclone separator. In separation vessel 22, pressure and temperature conditions are maintained so that any water in the gaseous effluent stream, as well as the injected water, remains in the vapor phase while the heavy oils and tars condense. The condensed heavy oils and tars, which are free of water and light hydrocarbons, are removed as a concentrate from the separation vessel 22 through the tar removal line 40. The tar removal process may be either continuous or periodic. A diluent liquid may be injected into vessel 22 through the diluent injection line 46. As may be appreciated, the purpose of the diluent liquid is to prevent plugging of the tar removal line 40, in the event that the condensed material is solid or has a very high viscosity.

Separation vessel 22 serves to remove some or most of the tar upstream of the quench tower 24. For large plant designs, separation vessels 22 can be installed on each furnace 12 or, alternatively, one large separation vessel 22 can be installed for a combined process stream feed to a quench tower 24. If separation vessels 22 are installed on each furnace, one additional separation vessel 22 can be installed on the combined bottoms line for better separation of tar from lighter steam cracker effluent. The tar knockout from the separation vessel 22 can be fluxed with a highly aromatic compatible stream to keep it from fouling line 40. While the tar separation vessel 22 enables feeds having for example up to 15 wt % tar to be employed, it also reduces the tar entering the quench tower 24. An important benefit of the tar separation vessel 22 is that the more tar made, the greater the fraction of tar that goes to bottoms line 40 of the separation vessel 22. As may be appreciated, this improves the operability of quench tower 24 and quench drum 28, providing a synergistic benefit to the operation of the quench drum 28 with tar salvation, as will be more fully described below. The tar limit in the quench tower 24 is higher than typical gas cracker quench tower limits, due to the ability of the tar solvation step to better separate the tar from the quench water in the quench drum 28. Typical quench tower tar limits without tar salvation are about 1 wt %, typical of butane cracking, in the process qas feed to the tower. Tar solvation dramatically improves the quench water quality also for feedstocks that make <1 wt % tar, like ethane and propane.

As shown in the FIGURE, the gaseous effluent exits separation vessel 22 through line 72 and proceeds to the water quench tower 24. At this stage of the process the gaseous effluent is relatively free of the heavy oils and tars that are capable of forming a stable emulsion with water so that a simple water quench may be used to complete the cooling/condensing process. Upon entering the quench tower 24 the effluent is further cooled with recirculating quench water supplied through line 52. The quench zone of quench tower 28 may be of the standard design as is known in the art.

The quench water is removed from the quench tower 24 through line 74 and flows to an oil/water separation quench drum 28. From quench drum 28, the following liquid streams may be withdrawn: light oil plus heavy oils/tars through line 77, quench water through line 78. As may be appreciated, not all of the water must be returned to quench tower 24. The water may be sent to a solvent separator 30, discussed below, with some carried over light oil and/or tar returned to quench drum 28 or to another separator 33. For sites that recycle dilution steam (not shown), the water may be sent to the steam generators. Advantageously, in such cases, the tar solvation greatly reduces steam generator fouling. Benefits may also be realized for gas cracker systems that do not recycle steam.

As indicated above, in the inventive process, tar solvation has been found to improve the separation of tar in a quench drum fed by the bottoms of the quench tower for gas feeds. A light aromatic solvent, e.g., a hydrotreated steam cracking pyrolysis gasoline, may be introduced into the feed through line 50 into quench drum 28. Solvent to tar ratios of from about 0.5:1 to about 5:1, preferably closer to about 5:1, should be maintained in quench drum 28 to keep the tar solvated. The solvent is injected substantially continuously. Advantageously, the solvent keeps the tar from sinking to the bottom of quench drum 28 and keeps tar out of the water phase leaving quench drum 28 through line 78. In another form, the solvent may be injected through line 56 into the water leaving quench drum 28 through line 78. The light hydrocarbons separated by the solvent separator 30 are withdrawn through line 31 and sent to a separation vessel 33 to separate the solvent from the tar with a hydrocarbon recycle line 58 back to the drum.

Optionally, it may be advantageous in certain operations to employ a periodic wash of the quench tower, using a steam cracked gas oil (about 430° F. to about 550° F. $C_{5+}$cut), such as at about two-week intervals. The wash fluid may be introduced at line 80 into the top of the quench tower and may be effective to wash out heavy foulant from quench tower 24.

The solvent employed can be a product of the cracked feedstock, such as hydro-fined steam cracked naphtha or imported from another plant process. Due to the use of tar solvation, the water leaving quench drum 28 should be clear and clean, and thus avoids downstream or later fouling of the quench circuit typically attributable to tar. Tar solvation turns the drum 28 from a three phase separator with tar on the bottom, to a two phase separator with tar in the top light hydrocarbon phase. The hydrocarbons withdrawn through line 77 from quench drum 28 are preferably fed to a light aromatic solvent separator 33. The light hydrocarbons separated by the light aromatic solvent separator 30 are withdrawn through line 31 and sent to a separation vessel 33 to separate the solvent from the tar. Recovered solvent is withdrawn through line 58 and sent back to the quench drum 28 for solvent reuse Referring again to FIG. 1, a preferred process according to this invention includes a process for cracking liquid hydrocarbon feed in a system for cracking gaseous hydrocarbons, using a thermal cracker 12, preferably a gas cracker, such as an ethane cracker, although alternatively the cracker may be steam cracker or other liquid cracker. The liquid hydrocarbon feed stream comprises at least one of crude, condensate, kerosene, field natural gasoline, and naphtha. The process provides methods and apparatus for cracking liquid hydrocarbons feeds 10 in a cracker 12, with the ability to manage the produced tar products, which would otherwise result in deposition and/or other buildup of tar in the post-cracking process equipment. In a preferred aspect, the process includes a method for cracking hydrocarbons in a thermal cracker 12, preferably a gas cracker, using a tar knockout separator 22 ahead of a water quench tower 24, with tar solvation and a quench drum 28 to process the tar bottom stream 74 from the quench tower 22. A preferred process may comprise the steps of (a) feeding a liquid hydrocarbon feed stream 10 to a thermal cracker 12; (b) cracking the liquid hydrocarbon feed stream 10 in the thermal cracker to produce a cracked effluent; (c) feeding the cracked effluent 62 from the thermal cracker to a transfer line heat exchanger (TLE) 16; (d) feeding the cracked effluent from the TLE 16 to a first separator 22; (e) separating the cracked effluent from the TLE 16 in the first separator 22 into a first separator bottoms stream 40 comprising tar and a first separator product stream 72; (f) feeding the first separator product stream 72 to a second separator 24; (g) feeding a second separator quench fluid, such as through line 52, to the second separator 24 to quench the first separator product stream 72; (h) separating in the second separator 24, a second separator bottoms stream 74 comprising tar and a second separator product stream 54 comprising an olefin product; and (i) treating the second separator bottoms stream 74 in a solvation process to separate tar from at least one of water and any other second separator quench fluid. Preferably the first separator 22 is a tar knockout vessel or system, the second separator is a quench tower 24, preferably a water quench tower, and preferably, the tar solvation system includes a quench drum 28 to separate the quench fluid from the tar. The quench tower system may include one or more of water or hydrocarbon quench oil as a second quench fluid to quench the first separated product stream in the second separator. Water and/or other quench fluid is recovered in the salvation system for recirculation or other disposition.

A preferred process may also comprise the step of feeding a first quench fluid, such as through line 44, such as water or quench oil, into the cracked effluent 47 from the TLE 16, such as in a bypass line 48, that bypasses a secondary TLE 18, before the cracked effluent enters the first separator 22, to quench the cracked effluent from the TLE 16. Feed to the bypass line 48 (e.g., the line that bypasses the secondary TLE 18) may be controlled such as by valves 64 and 66. Also, a first separator solvent may be provided, such as through line 46, to the first separator 22 to aid separation within the first separator of tar from the first separator product stream. The first separator solvent may preferably comprise an aromatic hydrocarbon. The step of providing the first separator solvent 46 may, in various embodiments as desired, comprise injecting a solvent into at least one of (i) the cracked effluent line 47 or 48, (ii) the first separator 22, and (iii) the separator bottoms stream 40, or any combination thereof, as needed to prevent tar buildup. The first separator 22 may preferably comprise either or both of a drum type separator and/or a cyclone type separator. A preferred first quench fluid 44 may be selected from at least one of water, steam, and hydrocarbon quench oil. Further, an aromatic solvent may be introduced, such as through line 50, into the second by-product stream 74 from the quench tower 24 to aid separation of tar in the tar solvation system.

The step of treating the second separator 24 bottoms stream 74 in a solvation process preferably comprises: (i) treating the second separator bottoms in a quench drum 28; and (ii) recovering from the quench drum, the second quench fluid, such as from lines 77 and/or 78. Preferably, the second quench fluid is recycled to the second separator, such as through line 52, although in some embodiments, it may only be used once through.

According to a preferred process, the TLE comprises a primary TLE 16 and a secondary TLE 18 downstream of and in fluid communication with the primary TLE, and the process further comprises the steps of; bypassing the secondary TLE 18 with a bypass cracked effluent stream 48 from the primary TLE; and feeding a first quench fluid 44 into the bypass cracked effluent stream 48 and feeding both the first quench fluid and the bypass cracked effluent to the first separator 22.

In another preferred embodiment, as illustrated again in FIG. 1, another preferred embodiment integrates in a gas cracker system, each of the secondary TLE bypass system, the pre-first separator quench fluid injection system 44, the first separator system 22, and the tar solvation system 28, to facilitate cracking of liquid feedstocks in the gas cracker system for cracking gaseous feedstocks. The system may include (i) a thermal gas cracker 12 for producing a process effluent comprising olefins; (ii) at least one transfer line exchanger (TLE) 16 for the recovery of process energy from the effluent; and (iii) a quench tower system 24, and may operate according to a process for thermally cracking liquid feedstocks that yield tar in a cracked effluent from the thermal cracker, wherein the process comprises the steps of: (a) feeding a first quench fluid, such as through line 42, downstream of at least one of the at least one TLE 16 to quench the process effluent 62 from the thermal cracker 12; (b) separating the quenched effluent in a first separator 22 into a first separator product stream 72 comprising olefins and a first separator byproduct stream 40 comprising tar; (c) feeding the first separator product stream 72 to the quench tower system 24; (d) quenching the first separator product stream 72 in the quench tower system 24 with a second quench fluid, such as by line 52, wherein a heat exchanger 26 may be included to adjust the temperature of line 52; (e) recovering from the quench tower system 24, a cracked product effluent 54 comprising olefins and a second byproduct stream comprising tar 74; (f) directing the second byproduct stream 74 to a tar solvation system; and (g) separating the second byproduct stream 74 in the tar solvation system, preferably including a quench drum 28, into a third byproduct stream 78 comprising substantially water, and a hydrocarbon stream 77 comprising a mix of tar salvation system and solvent and tar. According to this invention, the substantially water stream 78 is relatively clean or hydrocarbon-free water as compared to the quality of water obtained in other tar solvation processes.

The solvent and tar mixture 77 preferably may be further separated in a solvent recovery vessel 33. Recovered solvent and/or quench oil may be recycled, via line 58, such as to the quench drum 28 and/or the quench tower 24 (via line 52), or to other disposition. Tar may be removed from the system, as shown by line 60.

In a preferred process, the step of separating the second byproduct stream 74 in the tar solvation system comprises: (i) injecting an aromatic solvent, such as via line 50, into the second byproduct stream 74, to form a solvent/third byproduct mixture 77; and (ii) directing the solvent/third byproduct mixture 77 to a solvent separation drum 33 to further separate the solvent 58 from the tar 60.

During normal operation, the substantially water stream 78 and/or 39 will be relatively clean and free of tar or other hydrocarbon contaminants. This relatively clean water stream 39 may be recycled to a dilution generator and used for furnace steam. Otherwise, the clean water from stream 78 or 39 may be used as once through steam and sent to waste water or for other processing or disposition.

In the event quench drum 28 realizes a buildup of tar or other condensables, solvent may be injected via line 50 to aid removal of such material from the system. During such operation or at any other time where some solvent and/or tar enters the water discharge line 78, separator 30 may be provided to further separate water from the hydrocarbons. The substantially clean water stream may be removed through line 39 and the hydrocarbons removed through line 31 to a tar-solvent separation drum 33 for separation of the solvent form the tar. If line 78 experiences a buildup of tar or other condensables, some carryover of such tar might occur within water stream 78. In such event it may be desirable to introduce a solvent 56 into the water line 78 to keep the tar dissolved and aid production of relatively clean water from separator 30. The introduced solvent 56 may be recovered in separators 30 and 33. In some embodiments, separators 30 and 33 may be process towers or fractionators.

Referring still to FIG. 1, the process further comprises the steps of: (i) feeding a first quench fluid 44, such as water, steam, or a quench oil, into the cracked effluent stream 48 before the cracked effluent enters the first separator 22, to quench the cracked effluent from the TLE 16; and (ii) feeding the mixture of the first quench fluid and the cracked effluent to the first separator 22. This step may enable bypassing other TLE's, such as secondary TLE's 18, to avoid tar buildup in such secondary TLE's and to permit tar condensation or precipitation substantially immediately before the tar is collected and separated in the first separator system. Thereby, the tar may experience a controlled quench and/or a quenching with a quench fluid that inhibits tar to plate out on the equipment surfaces, crosslink, and/or conversion to asphaltenes or a tar product that is difficult to remove from the system later. After the tar enters the first separator 22, e.g., preferably a tar knockout drum, the tar and any other condensed materials may be removed from the effluent stream via the first separator 22.

In another embodiment, the at least one transfer line exchanger for the recovery of process energy from the cracked effluent stream 62 may include at least a primary TLE 16 and a secondary TLE 18 positioned downstream of and in fluid communication with the primary TLE 16, comprises the steps of: (i) bypassing the secondary TLE 18 with a bypass cracked effluent stream 48 from the primary TLE 16; and (ii) feeding a first quench fluid, such as by one or each of line 42 or 44, into the bypass cracked effluent stream 48, upstream of the first separator 22 and feeding both the first quench fluid and the bypass cracked effluent to the first separator 22. The first quench fluid may preferably be selected from at least one of water, steam, and hydrocarbon quench oil. When the secondary TLE 18 is used for cooling the effluent, the first quench fluid may be introduced periodically, such as through line 42, at for example once per day for up to an hour per period, and may function primarily to clean the secondary TLE. When the secondary TLE is being bypassed, the effluent will require cooling or quenching before the effluent enters separator 22. In such case it may be preferable to introduce the first quench fluid into the effluent such as via line 44, whereby the introduction or feeding of the first quench fluid is performed substantially continuously. First quench fluid feed rates may vary from a first quench fluid to effluent ratio of from about 0.5:1 to about 5:1. These same rates may also apply for periodic cleaning of the first or second TLE. Preferred rates will vary according to the tar yield and amount of quenching required.

In many preferred processes, such as when feeding a heavier, lower cost feedstock, such as crude, to a gas cracker, the preferred process also includes providing a flash separation step and apparatus in the feed stream before the feed is cracked in the radiant section of the cracker 12. Such process may help reduce the amount of non-volatile components introduced into the cracker. This process may also be useful for other liquid feeds, such as condensate, kerosene, field natural gasoline, and naphtha, including LVN and HVN. A preferred non-volatile component reduction process may comprise the steps of: (i) feeding the liquid hydrocarbon feed 10 to a convection section of the thermal cracker 12 to heat/preheat the feed; (ii) feeding the heated feed from the convection section, such as via line 2, to a flash separation apparatus 14 to separate an overhead feed stream 4 from a non-volatile bottoms stream 32; (iii) feeding the overhead feed stream 4 back to the thermal cracker, preferably back to the convection section, for cracking in the radiant section to produce the process effluent 62; and (iv) removing the non-volatile bottoms stream 32 from the flash separation apparatus 14.

In addition to providing a simplified flow diagram of some preferred processes according to the present invention, FIG. 1 also provides a simplified diagram illustrating some preferred arrangements of apparatus, equipment or systems useful to practice the invention. A preferred apparatus includes a gas cracking system 12 that is fed a liquid hydrocarbon feedstock 10. A preferred process may include: (a) a thermal gas cracker 12 for receiving a liquid hydrocarbon feed stream 10, the cracker comprising a convection section and a radiant section to produce an process effluent comprising olefins; (b) a primary transfer line exchanger (TLE) 16 to receive the cracked effluent 62 from the cracker, for the recovery of process energy from the cracked effluent; (c) a first separator system 22 for receiving the cracked effluent from the TLE 16 and separating the cracked effluent into a first separator byproduct stream comprising tar 40 and a first separator product stream 72; (d) a second separator system 24 to receive the first separator product stream 72 and separate the first separator product stream into an overhead cracked gas effluent 54 for recovery and a second byproduct stream comprising tar 74; and (f) a tar solvation system, including quench drum 28, and preferably separator 30, for receiving the second byproduct stream 74, wherein the tar solvation system is in fluid communication with and downstream of the second separator system 24 for receiving the second byproduct stream comprising tar 74.

The apparatus also preferably includes a first quench fluid injection line 42 and/or 44, for introducing a first quench fluid into the cracked effluent 62, 47, and/or 48, at a quenched effluent flow-path position that is downstream of the primary TLE 16 and upstream of the first separator 22, to quench the process effluent before the process effluent enters the first separator 22. The preferred apparatus also comprises a secondary TLE 18 in fluid communication with and downstream of the primary TLE 16, and the quenched effluent flow-path proceeds from the primary TLE 16, bypasses the secondary TLE 18, and feeds into the first separator 22, and wherein the first quench fluid is introduced, such as by lines 42 or 44, into the cracked effluent at a position along the quenched effluent flow-path, including lines 47 and 48, and valve 66, that is between the primary TLE 16 and the first separator 22.

As with the preferred processes discussed above, in a preferred apparatus system, the second separator 24 preferably comprises a quench tower system, more preferably a water quench tower system although in some embodiments it may be an hydrocarbon/oil based quench tower system, for quenching the first separator product stream. Preferably, the tar solvation system includes a tar solvation quench drum 28 for receiving the second byproduct stream 74 and separating a substantially water stream from a hydrocarbon stream including hydrocarbon solvents, quench oil, and/or tar.

A preferred apparatus also comprises an olefin recovery train (not shown) for recovering olefins from the overhead cracked gas effluent 54 from the second separator 24. When needed, an aromatic solvent, more preferably a light aromatic solvent, may be injected, such as via line 56, into the third or quench drum byproduct stream 78 to form a solvent/quench drum byproduct mixture upstream of the tar-solvent separator 30. A quench water stream 78 and a third byproduct stream 77 are produced by the tar solvation quench drum 28. In a preferred embodiment, a tar-solvent separation drum 30 receives the quench drum water byproduct stream 78 from the tar salvation quench drum 28 and recovers any carried over solvent from the quench drum byproduct stream.

Preferred apparatus may also provide for a system wherein the tar solvation process separates the second quench fluid 52 from tar 60 and the recovered second quench fluid is recycled, such as via lines 58 and 52, to the second separator system, and introduced into the second separator 24. A preferred apparatus comprises a quench tower feed line 52 that feeds a second separator quench fluid from a second separator quench fluid feed 80, and/or a recycled solvent feed 58 from the solvation system into the quench tower 24. In some preferred embodiments, the second separator quench fluid may comprise an aromatic, such as a heavy aromatic, steam, water, or a steam cracked gas oil/pyrolysis gasoline wash fluid, into the quench tower 24.

The apparatus of claim 26, further comprising: (i) a secondary TLE in fluid communication with and downstream of the primary TLE; and (ii) a second TLE solvent introduction port upstream of the second TLE and downstream of the primary TLE, to introduce a second TLE solvent into the second TLE for cleaning the second TLE. As discussed previously, for heavier liquid feeds or those feeds comprising a substantial component of non-volatile materials, such as resids and/or asphaltenes, the preferred system apparatus may further comprise: (i) a convection section in the thermal cracker 12 to heat the hydrocarbon feed 10; (ii) a flash separation apparatus 14 to receive the convection section heated hydrocarbon feed and separate an overhead feed stream 4 from a non-volatile bottoms stream 32; (iii) feeding the separated overhead feed stream 4 to the thermal cracker for cracking to produce the process effluent 62; and (iv) removing the non-volatile bottoms stream 32 from the flash separation apparatus 14. The overhead 4 from the flash separation apparatus 14 is preferably fed to the convection section of the thermal cracker before cracking the overhead in a radiant section of the thermal cracker.

The inventive combination of implementing a tar separation vessel 22 downstream of the primary TLE 16 and optional secondary TLE 18, upstream of quench tower 24, together the use of a solvent in quench drum 28, serves to enable gas cracker 12 operation with feeds employing up to 10 wt % tar. In plant operation, this permits the relaxation of the maximum tar yield specification for feedstocks from levels that enable only ethane through butane feed, all the way to kerosene or crudes that may yield substantial amounts of tar. As may be appreciated, in periods of high natural gas pricing, relative to crudes, gas cracker plants have economic incentives to move toward the heaviest feeds that are operable with minimum capital investment, despite the fact that the most attractive lower cost feeds typically make significantly more tar. As disclosed herein, this inventive process and apparatus is achieved without expensive modifications being made to the existing quench towers. Additionally, there is no need to employ a costly primary fractionator in the existing gas cracker system.

In operation, the following table presents exemplary contemplated system requirements according to various feed characteristics:

TABLE

| Feed | Vapor Liquid Separator | Tar Yield | Primary TLE | Secondary TLE | Tar Knockout | Quench Drum |
|---|---|---|---|---|---|---|
| LVN, HVN, FNG | No | 1-3% | Normal Normal | Bypass with Water or Quench Oil Injection or Use Secondary TLE with Steam or Quench Oil Periodic Flushing | Yes | Tar Solvation |
| Condensate | No | 3-5% | Normal or Periodic Flushing with Water or Quench Oil | Bypass or Use w/ Periodic Flushing w/ Steam or Quench Oil | Yes | Tar Solvation |
| Kerosene | No | 5-9% | Normal or Periodic Flushing with Quench Oil | Bypass or Use w/ Periodic Flushing w/ Steam or Water or Quench Oil | Yes | Tar Solvation |
| Crude | Yes | 10% | Normal or Periodic Flushing with Quench Oil | Bypass or Use w/ Periodic Flushing w/ Steam or Water or Quench Oil | Yes | Tar Solvation |

All patents, test procedures, and other documents cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the invention, including all features which would be treated as equivalents thereof by those skilled in the art to which the invention pertains.

What is claimed is:

1. A process for cracking liquid hydrocarbon feed in a system for cracking gaseous hydrocarbons, the process comprising the steps of:

(a) feeding a liquid hydrocarbon feed stream to a thermal cracker;

(b) cracking a vaporized portion of the liquid hydrocarbon feed stream in the thermal cracker to produce a cracked effluent;

(c) feeding the cracked effluent from the thermal cracker to a transfer line heat exchanger (TLE);

(d) feeding the cracked effluent from the TLE to a first separator;

(e) separating the cracked effluent from the TLE in the first separator into a first separator bottoms stream comprising tar and a first separator product stream;

(f) feeding the first separator product stream to a second separator;

(g) feeding a second separator quench fluid to the second separator to quench the first separator product stream;

(h) separating in the second separator, a second separator bottoms stream comprising tar and a second separator product stream comprising an olefin product; and (i) treating the second separator bottoms stream in a solvation process to separate tar from at least one of water and the second separator quench fluid.

2. The process of claim 1, further comprising the step of feeding a first quench fluid into the cracked effluent from the TLE before the cracked effluent enters the first separator, to quench the cracked effluent from the TLE.

3. The process of claim 1, wherein the first separator includes a tar knockout vessel.

4. The process of claim 1, wherein the second separator includes a quench tower system.

5. The process of claim 4, wherein the quench tower system includes at least one of water and hydrocarbon quench oil as a second quench fluid to quench the first separated product stream in the second separator.

6. The process of claim 1, wherein the step of treating the second separator bottoms stream in a solvation process comprises:

(i) treating the second separator bottoms in a quench drum; and (ii) recovering from the quench drum, the second quench fluid.

7. The process of claim 6, further comprising the step of:

recycling the second quench fluid to the second separator.

8. The process of claim 1, further comprising the step of providing a first separator solvent to the first separator to aid separation within the first separator of tar from the first separator product stream.

9. The process of claim 8, wherein the first separator solvent comprises an aromatic hydrocarbon.

10. The process of claim 8, wherein the step of providing the first separator solvent comprises injecting a solvent into at least one of (i) the cracked effluent; (ii) the separator; and (iii) the separator bottoms stream.

11. The process of claim 1, wherein the first separator comprises at least one of a drum type separator and a cyclone type separator.

12. The process of claim 1, further comprising the steps of:

(i) feeding a first quench fluid into the cracked effluent stream before the cracked effluent enters the first separator, to quench the cracked effluent from the TLE; and (ii) feeding both the first quench fluid and the cracked effluent to the first separator.

13. The process of claim 1, wherein the TLE comprises a primary TLE and a secondary TLE downstream of and in fluid communication with the primary TLE, and the process further comprises the step of:

bypassing the secondary TLE with a bypass cracked effluent stream from the primary TLE; and feeding a first quench fluid into the bypass cracked effluent stream and feeding both the first quench fluid and the bypass cracked effluent to the first separator.

14. The process of claim 1, wherein the cracked effluent from the thermal cracker comprises at least about 2 wt % of tar.

15. The process of claim 1, wherein the liquid hydrocarbon feed stream comprises at least one of crude, condensate, kerosene, field natural gasoline, and naphtha.

16. In a thermal gas cracker system for cracking gaseous feedstocks, the system including (i) a thermal gas cracker for producing a process effluent comprising olefins, (ii) at least one transfer line exchanger (TLE) for the recovery of process energy from the effluent, and (iii) a quench tower system, a process for thermally cracking liquid feedstocks that yield tar in a cracked effluent from the thermal cracker, said process comprising the steps of:

(a) introducing a first quench fluid into the cracked effluent downstream of at least one of the at least one TLE to quench the cracked effluent from the thermal cracker;

(b) separating the quenched effluent in a first separator into a first separator product stream comprising olefins and a first separator byproduct stream comprising tar;

(c) feeding the first separator product stream to the quench tower system;

(d) quenching the first separator product stream in the quench tower system with a second quench fluid;

(e) recovering from the quench tower system, a cracked product effluent comprising olefins and a second separator byproduct stream comprising tar;

(f) directing the second separator byproduct stream to a tar solvation system; and (g) separating the second separator byproduct stream in the tar solvation system into a stream comprising water and a stream comprising at least one of tar and tar solvation system solvent.

17. The process of claim 16, wherein the first quench fluid is selected from at least one of water, steam, and a hydrocarbon quench oil.

18. The process of claim 16, further comprising the step of injecting an aromatic solvent into the second separator byproduct stream from the quench tower to aid separation in the tar solvation system.

19. The process of claim 16, wherein the first separation vessel is a cyclonic separator.

20. The process of claim 16, wherein the separation vessel is a substantially cylindrical vertical drum.

21. The process of claim 16, wherein the step of separating the second separator byproduct stream in the tar solvation system further comprises:

injecting an aromatic solvent into at least one of the second separator byproduct stream and a quench drum to form a solvent/second separator byproduct mixture; and separating the solvent/second separator byproduct mixture into a stream comprising water and a stream comprising a mixture of solvent/tar.

22. The process of claim 21, further comprising the step of separating the solvent tar stream in a tar-solvent separation process into a stream comprising tar and a stream comprising recovered solvent.

23. The process of claim 22, further comprising the step of recycling the recovered solvent to the quench drum.

24. The process of claim 16, wherein the at least one transfer line exchanger for the recovery of process energy from the effluent includes a primary TLE and a secondary TLE positioned downstream of and in fluid communication with the primary TLE, further comprising the step of:

bypassing the secondary TLE with a bypass cracked effluent stream from the primary TLE; and feeding a first quench fluid into the bypass cracked effluent stream upstream of the first separator and feeding both the first quench fluid and the bypass cracked effluent to the first separator.

25. The process of claim 24, wherein the first quench fluid is selected from at least one of water, steam, and a hydrocarbon quench oil.

26. The process of claim 16, wherein the at least one transfer line exchanger for the recovery of process energy from the effluent includes a first TLE and a second TLE positioned downstream of and in fluid communication with the first TLE, further comprising the step of injecting steam upstream of the first transfer line exchanger for cleaning the first transfer line exchanger.

27. The process of claim 16, further comprising the step of feeding steam into the effluent upstream of the first transfer line exchanger for a period of at least about 15 minutes per day.

28. The process of claim 16, further comprising the step of feeding a solvent into the feed upstream of the second transfer line exchanger for cleaning the second transfer line exchanger.

29. The process of claim 16, wherein the liquid feedstock includes at least one of crude, condensate, kerosene, field natural gasoline, and naphtha.

30. The process of claim 16, wherein the process further comprises the steps of:

(i) feeding the liquid hydrocarbon feed to a convection section of the thermal cracker to heat the feed;

(ii) feeding the heated feed from the convection section to a flash separation apparatus to separate an overhead feed stream from a non-volatile bottoms stream;

(iii) feeding the overhead feed stream to the thermal cracker for cracking to produce the process effluent; and (iv) removing the non-volatile bottoms stream from the flash separation apparatus.

31. The process of claim 30, wherein the overhead from the flash separation apparatus is fed to the convection section of the thermal cracker.

* * * * *